United States Patent [19]

Nobesawa

[11] Patent Number: 4,631,378

[45] Date of Patent: Dec. 23, 1986

[54] PUSH BUTTON SWITCH

[75] Inventor: Shigeru Nobesawa, Sagamihara, Japan

[73] Assignee: Jelco. Co., Ltd., Japan

[21] Appl. No.: 662,686

[22] Filed: Oct. 19, 1984

[30] Foreign Application Priority Data

Oct. 31, 1983 [JP] Japan ..... 58-168619[U]

[51] Int. Cl.[4] ..... H01H 3/12

[52] U.S. Cl. ..... 200/340; 200/159 R

[58] Field of Search ..... 200/340, 159 B, 5 A, 200/159 R, 331, 153 K, 159 A

[56] References Cited

U.S. PATENT DOCUMENTS

| | | | |
|---|---|---|---|
| 598,033 | 1/1898 | Stout, Jr. | 200/159 R |
| 1,049,403 | 1/1913 | Rypinski | 200/159 R |
| 3,582,594 | 6/1971 | Twyford | 200/340 |
| 3,641,286 | 2/1972 | Berezowski | 200/159 R |
| 3,745,288 | 7/1973 | Reimer | 200/159 B |
| 3,819,882 | 6/1974 | Anderson et al. | 200/159 A |
| 3,826,885 | 7/1974 | Allen et al. | 200/159 B |
| 3,895,203 | 7/1975 | Leworthy | 200/159 R |
| 3,916,150 | 10/1975 | Abernethy et al. | 200/340 |
| 4,316,066 | 2/1982 | Muller et al. | 200/159 A |
| 4,351,988 | 9/1982 | Allbright | 200/340 |
| 4,408,103 | 10/1983 | Smith, III | 200/153 K |
| 4,440,992 | 4/1984 | Desmarais | 200/340 |

FOREIGN PATENT DOCUMENTS

| | | | |
|---|---|---|---|
| 2501410 | 9/1982 | France | 200/5 A |
| 1010830 | 11/1965 | United Kingdom | 200/340 |

*Primary Examiner*—Stephen Marcus
*Assistant Examiner*—Linda J. Sholl
*Attorney, Agent, or Firm*—Diller, Ramik, Wight

[57] ABSTRACT

An improved push button switch is disclosed which essentially comprises a key stem displaceable up and down in the switch mounting frame, a depressing portion fixedly secured to the key stem and a contact portion adapted to be turned on or off by depressing force transmitted from the key stem. The depressing portion is molded of plastic material integral with the key stem in such a configuration that it has resiliency which is effective in the vertical direction and extends from the side wall of the key stem. To give resiliency to the depressing portion the latter is preferably designed in the snake motion-shaped configuration extending in the vertical direction with a plurality of U-shaped bent parts formed thereon. A return spring is disposed so as to return the key stem to the original position and its upper end is engaged to an engagement portion which is located opposite to the depressing portion. The depressing portion may be designed in the cantilever-shaped configuration which extends from the key stem in such a manner as to surround a part or the whole of the periphery of the key stem. To damp bounding sound the cantilever-shaped depressing portion is formed with upwardly oriented projections which abut against the switch mounting frame during return movement of the key stem.

7 Claims, 9 Drawing Figures

PUSH BUTTON SWITCH

BACKGROUND OF THE INVENTION

1. FIELD OF THE INVENTION:

The present invention relates to a push button switch and more particularly to improvement of a push button switch of the type including a key stem displaceable by an operator's hand, a depressing portion fixedly secured to the key stem and a contact portion adapted to be turned on or off by depressing force transmitted from the key stem.

2. DESCRIPTION OF THE PRIOR ART:

In general, to assure that a push button switch of the above-mentioned type usable for key board or the like is produced at a reduced cost it is very important that it is designed as simple as possible with the minimized number of components and it is assembled by way of the reduced number of man-hours.

To facilitate understanding of the present invention it will be helpful that a typical conventional push button switch of the above-mentioned type will be described with reference to FIG. 1 as follows. As will be apparent from the drawing, the conventional push button switch is constructed such that a key stem 2 with a key top 1 fixedly secured thereto is vertically displaceably housed in the switch mounting frame 1, a depressing member 4 molded of elastomeric material and a return spring 5 in the form of a coil spring are arranged in a cavity 2*a* which is formed in the lower part of the key stem 2 and an upper contact 8*a* secured to a layer of film 8 and a lower contact 8*b* secured to a layer film are placed on the base plate 6 with a spacer 7 interposed therebetween. When the key top 2 is depressed by an operator's hand, the upper contact 8*a* is caused to come in contact with the lower contact 8*b* whereby electrical communication is established therebetween. To damp bounding sound which will be generated in the event of collision of the key stem 2 against the switch mounting frame 3 during return movement of the key stem 2 an O ring-shaped cushion 9 is fitted onto the key stem 2 at the position located on the shoulder of the latter.

However, it has been pointed out as a drawback with respect to the conventional push button switch that the latter is constructed by a number of components and thereby it is assembled only with a number of man-hours consumed therefor, resulting in production of the push button switch being achieved at an increased cost.

SUMMARY OF THE INVENTION

Thus, the present invention has been made with the foregoing drawback in mind and its object resides in providing an improved push button switch of the early-mentioned type which is constructed by the minimized number of components and of which assembling is achieved with the minimized number of man-hours at a reduced production cost.

To accomplish the above object there is proposed according to the present invention a push botton switch of the type including a key stem adapted to be slidably displaced downwardly or upwardly in a switch mounting frame by depressing a key top by an operator's hand or releasing it from the depressed state, a depressing portion displaceable together with the key stem and a contact portion adapted to be turned on or off by depressing force transmitted from the key stem via the depressing portion, wherein the improvement consists in that the depressing portion is molded of plastic material integral with the key stem in such a configuration that it has resiliency which is effective in the vertical direction and extends from the side wall of the key stem.

In a preferred embodiment of the invention, to give the depressing portion resiliency which is effective in vertical direction it is molded of plastic material integral with the key stem in the S-shaped configuration, snake motion-shaped configuration or the like configuration.

Alternatively, the depressing portion may be designed in the cantilever-shaped configuration which extends from the side wall of the key stem.

To damp bounding sound which is generated in the event of collision of the key stem against the switch mounting frame the depressing portion is preferably formed with upwardly oriented projections adapted to abut against the upper inner wall of the switch mounting frame.

Other objects, features and advantages of the invention will become more clearly from reading of the following description which has been prepared in conjunction with the accompanying drawings.

BRIEF DESCRIPTION OF THE DRAWINGS

The accompanying drawings will be briefly described below.

DESCRIPTION OF THE PREFERRED EMBODIMENTS

Now, the present invention will be described in a greater detail hereunder with reference to FIGS. 2 to 9 which illustrate preferred embodiments of the invention.

Figure 1:
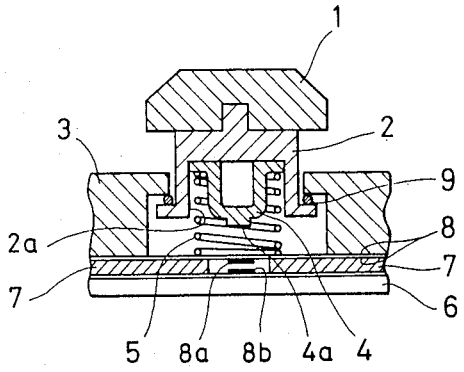
FIG. 1 is a vertical sectional view of a typical conventional push button switch.
Figure 2:
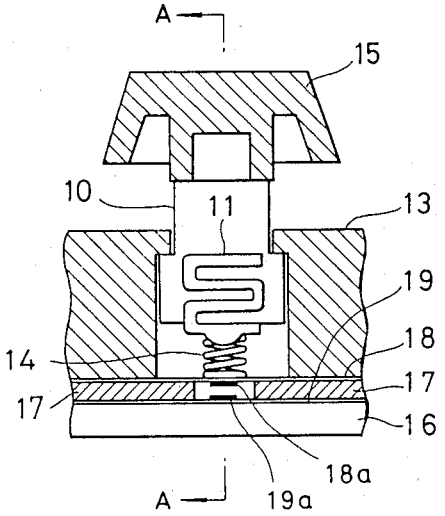
FIG. 2 is a vertical sectional view of a push button switch in accordance with the first embodiment of the invention.
Figure 3:
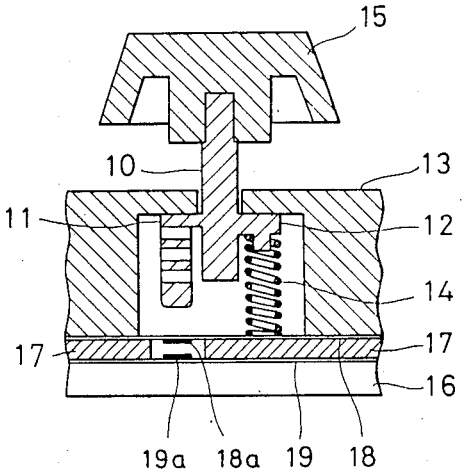
FIG. 3 is a vertical sectional view of the push button switch taken in line A—A in FIG. 2.

First, description will be made as to a push button switch in accordance with the first embodiment of the invention with reference to FIGS. 2 and 3, wherein FIG. 2 is a sectional view of the push button switch and FIG. 3 is another sectional view of the same taken in line A—A in FIG. 2. A key stem 10 is made of plastic material by molding process and includes a depressing portion 11 and an engagement portion 12 both of which are molded integral with the key stem 10.

As is apparent from the drawings, the key stem 10 is molded of plastic material in the solid structure and therefore it has excellently high dimensional stability after completion of molding operation. Thus, it can be fitted to a switch mounting frame 13 with high accuracy. The depressing portion 11 is constructed by a band-shaped member which extends downwardly in the snake motion configuration and of which upper end part is made integral with the key stem 10 at the substantially central position on the one side surface thereof (see FIG. 3). On the. other hand, the engagement portion 12 is adapted to come in engagement to the upper end of a return spring 14 and it is made integral with the key stem 10 at the position located opposite to the depressing portion 11 relative to the key stem 10. Namely, both the depressing portion 11 and the engagement portion 12 are arranged in the symmetrical relation relative to the key stem 10. It should of course be understood that since the depressing portion 11 is molded of plastic material, it has resiliency which is effective in the vertical direction.

The key stem 10 is housed in the switch mounting frame 13 and has a key top 15 fixedly fitted to the upper end part thereof.

Further, on the base plate 16 are arranged a layer of film 18 with an upper contact 18*a* secured thereto and a layer of film 19 with a lower contact secured thereto while a spacer 17 is interposed between both the films 18 and 19. The thus arranged contact portion comprising contacts 18*a* and 18*b* on the films 18 and 19 is located opposite to the lowermost end part of the depressing portion 11 which is molded integral with the key stem 10. As will be best seen in FIG. 3, the return spring 14 is extended between the film 18 and the engagement portion 12 which is molded integral with the key stem 10.

Now, the push button switch of the invention is finally built by fixedly attaching the switch mounting frame 13 and the base plate 16 to a key board or the like which is not shown in the drawings.

In the illustrated state where the key top 15 is not still depressed the key stem 10 is raised up under the effect of resilient force of the return spring 14 whereby the push button switch is turned off.

As the key top 15 is depressed against resilient force of the return spring 14, the key stem 10 is caused to move downwardly until the lower end part of the depressing portion 11 comes in contact with the film 18. When the key top 15 is depressed further, the upper contact 18*a* on the film 18 is brought in contact with the lower contact 19*a* on the film 19 whereby the push button switch is turned on.

Figure 4:
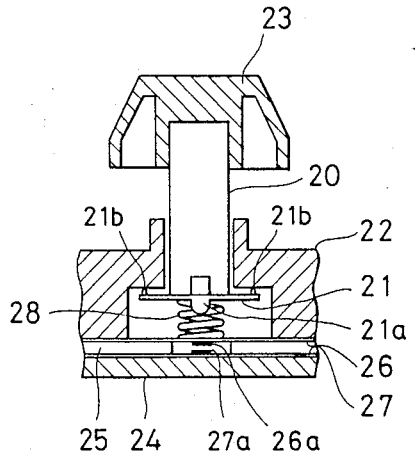
FIG. 4 is a vertical sectional view of a push button switch in accordance with the second embodiment of the invention.
Figure 5:
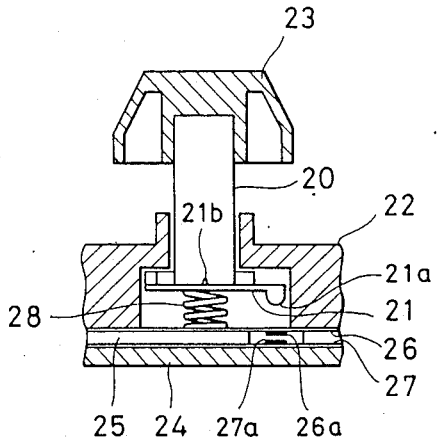
FIG. 5 is a vertical sectional view of the push button switch in FIG. 4 sectioned in the same way as in FIG. 3.

Next, description will be made as to a push button switch in accordance with the second embodiment of the invention with reference to FIGS. 4 and 5, wherein FIG. 4 is a sectional view of the push button switch and FIG. 5 is another sectional view of the same sectioned along the located at the position turned by a right angle relative to the plane of FIG. 4. A key stem 20 is made of plastic material by molding process in such a manner that a depressing portion 21 is integrally secured to the key stem 20.

Figure 6:
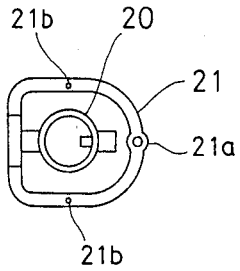
FIG. 6 is a plan view of a combination of key stem and depressing portion for the push button switch as illustrated in FIGS. 4 and 5.
Figure 7:
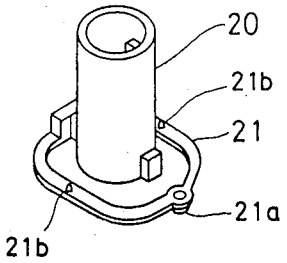
FIG. 7 is a perspective view of the combination in FIG. 6.

To facilitate understanding of the configuration of the key stem 20 and the depressing portion 21 FIGS. 6 and 7 will be helpful, wherein FIG. 6 is a plan view of both the key stem 20 and the depressing portion 21 and FIG. 7 is a perspective view of the same. The depressing portion 21 is horizontally extended from the one side wall of the key stem 20 in the cantilever fashion and a downwardly oriented projection 21*a* is formed at the foremost end of the depressing portion 21 for the purpose of depressing a contact 26*a*. Further, a pair of upwardly oriented projections 21*b* are formed at the substantially middle position of the depressing portion 21 for the purpose of damping bounding sound which will be otherwise generated when the depressing portion 21 abuts against the switch mounting frame 22. It should of course be understood that since the depressing portion 21 is molded of thin plastic material, it has resiliency which is effective in the vertical direction to inherently augment the damping effect of the projections 21*b*, as is self-evident from the drawings.

The key stem 20 is housed in the switch mounting frame 22 and a key top 23 is fixedly secured to the upper end part of the key stem 20.

On the other hand, on the base plate 24 are arranged a layer of film 26 with an upper contact 26*a* secured thereto and a layer of film 27 with a lower contact 27*a* secured thereto while a spacer 25 is interposed between both the films 26 and 27. A return spring 28 is disposed in the space as defined between the lowermost end of the key stem 20 and the upper film 26.

Now, the push button switch of the invention is finally built by fixedly attaching the switch mounting frame 22 and the base plate 24 to a key board or the like which is not shown in the drawings.

In the illustrated state in FIGS. 4 and 5 where the key top 23 is not still depressed by an operator the key stem 20 is raised up under the effect of resilient force of the return spring 28 whereby the push button switch is turned off.

As the key top 23 is depressed by him against resilient force of the return spring 28, the key stem 20 is caused to move downwardly until the projection 21*a* on the depressing portion 21 comes in contact with the upper film 26. When the key top 23 is depressed further, the upper contact 26*a* on the film 26 is brought in contact with the lower contact 27*a* on the film 27 whereby the push button switch is turned on.

Next, when the key top 23 is released from the depressed state, the key stem 20 is displaced upwardly under the effect of resilient force of the return spring 28 together with the depressing portion 21 until the projections 21*b* abut against the upper inner wall of the switch mounting frame 22 (see FIG. 4). Thus, the key stem 20 is kept immovably. At this moment the projections 21*b* serve to damp bounding sound which will be otherwise generated when the depressing portion 21 abuts against the switch mounting frame 22 during return movement of the key stem 20.

Figure 8:
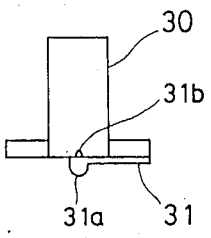
FIG. 8 is a front view of another combination of key stem and depressing portion modified from that in FIGS. 6 and 7.
Figure 9:
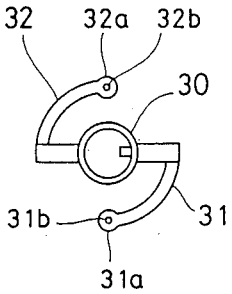
FIG. 9 is a plan view of the combination in FIG. 8.

FIGS. 8 and 9 illustrate a combination of the key stem and the depressing portion in accordance with an embodiment modified from that in FIGS. 4 to 7, wherein FIG. 8 is a front view of the combination and FIG. 9 is a plan view of the same. In the modified embodiment the key stem 30 has two depressing portions 31 and 32 formed integral therewith. Downwardly oriented projections 31*a* and 32*a* are formed at the foremost end of the depressing portions 31 and 32 for the purpose of depressing contacts, while upwardly oriented projections 31*b* and 32*b* are formed also at the foremost end of the same for the purpose of damping bounding sound.

In the foregoing embodiments a return spring in the form of a coil spring is disposed in the space as defined between the lowermost end of the key stem and the contact portion. However, the present invention should not be limited only to this. Alternatively, properly designed cushion made of elastomeric material such as rubber or the like may be disposed there. Further, in the illustrated embodiments film based contact is employed as contact portion but the present invention should not be limited only to this. Any type of contact portion may be employed as far as it is turned on or off by downward or upward movement of the key stem. Further, the number of depressing portions and the configuration of the same should not be limited only to those as illustrated in the drawings. The number and configuration of depressing portions may be determined under such conditions that they are designed so as to have a certain resiliency which is effective in the vertical direction, that they are extended from the one side wall of the key stem and that they are made integral with the key stem by molding process using plastic material.

What is claimed is:

1. A push button switch comprising an integral homogeneous one piece molded plastic key stem and cantilever portion, said key stem having a longitudinal axis, means for mounting said key stem for sliding movement relative to a switch mounting frame generally parallel to said longitudinal axis, a contact positioned so as to be closed upon movement of said key stem in a first direction, said integrally molded cantilever portion lying generally in a plane transverse to said longitudinal axis, said cantilever portion being at least in partial surrounding and partial circumferentially spaced relationship to said key stem, said cantilever portion being relatively thin and resilient in said first direction and in an opposite second direction, said cantilever portion carrying oppositely directed projections, a first of said projections being operative for closing said contact upon movement of said key stem in said first direction, a second of said projections being operative for contacting said switch frame upon movement of said key stem in said second direction, said cantilever portion resilience and the projecting thereof effecting damping of said stem upon return movement toward said switch mounting frame, and a coil spring for moving said key stem in said second direction.

2. The push button as defined in claim 1 wherein said cantilever portion is defined by a generally annular portion completely surrounding said key stem in spaced relationship thereto, and a generally radial portion joining said annular portion to said key stem.

3. The push button as defined in claim 1 wherein said cantilever portion is defined by two generally annular portions each at least partially surrounding said key stem in spaced relationship thereto, said annular portions being directed oppositely relative to each other, and a generally radial portion joining each of said two annular portions to said key stem.

4. The push button as defined in claim 2 wherein said projections are carried by said annular portion.

5. The push button as defined in claim 2 wherein at least one of said projections is opposite said radial portion.

6. The push button as defined in claim 3 wherein each annular portion has an end carrying one each of said first and second projections.

7. A push button switch comprising an integral homogeneous one piece molded plastic key stem and oppositely diametrically directed cantilever portions, said key stem having a longitudinal axis, means for mounting said key stem for sliding movement relative to a switch mounting frame generally parallel to said longitudinal axis, a contact position so as to be closed upon movement of said key stem in a first direction, a first of said oppositely diametrically directed cantilever portions lying generally in a plane transverse to said longitudinal axis, said first oppositely diametrically directed cantilever portion carrying a generally undulating resilient contact portion having a free end aligned with said contact and being in radially and partially circumferentially spaced surrounding relationship to said key stem, said undulating contact portion being relatively thin and resilient in said first direction and in an opposite second direction, said free end of said undulating contact portion being operative for closing said contact upon movement of said key stem in said first direction, said cantilever portion resilient effecting damping of said stem upon return movement toward said switch mounting frame, and a coil spring between said spring frame and a second of said opposite diametrically directed cantilever portion for biasingly moving said key stem in said second direction to open said contact.

* * * * *